US006425432B1

(12) United States Patent
Gross et al.

(10) Patent No.: US 6,425,432 B1
(45) Date of Patent: Jul. 30, 2002

(54) CORD TILTER WITH AN ELEVATED START GEAR RATIO

(76) Inventors: Keith A. Gross; Fred J. Gross, both of 11915 Wicks St., Sun Valley, CA (US) 91352

( * ) Notice: Subject to any disclaimer, the term of this patent is extended or adjusted under 35 U.S.C. 154(b) by 0 days.

(21) Appl. No.: 09/664,689

(22) Filed: Sep. 19, 2000

(51) Int. Cl.[7] ..... E06B 9/30

(52) U.S. Cl. ..... 160/176.1 R; 160/177 R; 74/527

(58) Field of Search ..... 160/176.1 R, 177 R, 160/178.1 R; 74/527

(56) References Cited

U.S. PATENT DOCUMENTS 2,269,213 A * 1/1942 Lorentzen
2,579,197 A * 12/1951 Levine
2,580,252 A * 12/1951 Stubber et al.
4,245,687 A * 1/1981 Vecchiarelli
4,406,319 A * 9/1983 McNiel et al.
4,522,245 A * 6/1985 Anderson
4,541,468 A * 9/1985 Anderson
4,719,955 A * 1/1988 Tachikawa et al.
5,238,043 A * 8/1993 Woodring et al.
5,636,677 A * 6/1997 Liu
5,957,184 A * 9/1999 Gross et al.

* cited by examiner

*Primary Examiner*—Blair M. Johnson
(74) *Attorney, Agent, or Firm*—Albert O. Cota

(57) ABSTRACT

A venetian blind cord tilter, mounted in a head rail, that interfaces and drives a tilt rod, with the tilter itself having a wheel gear (20) to which lines are wound for rotating the tilt rod and subsequently slats held within ladders for opening and closing the blind. The wheel gear has a split wheel (22) which separates the lines that open and close the slats and an integral worm gear (26) is mounted on a shaft (24) to drive a separate helical gear (44) in which the tilt rod is inserted. The gears have an elevated start gear ratio to achieve a fast action when rotating the slats in the blind. A housing (50) retains the shaft and helical gear rotatably in place and provides for mounting the tilter within, a head rail (28). A cradle (58) is snapped into place beneath the housing and has a beveled projection (64) which is inserted into a square or rectangular hole in the bottom of the head rail (28) for mounting. An incremental positioning bushing (47) is disposed over the teeth (25) in the shaft to prevent backlash and permit positive angular displacement of blind slats used in conjunction with the tilter. The cradle (58) is interchangeable permitting the appropriate color to be used for coordinating the cradle (58) mating with the head rail (28).

18 Claims, 3 Drawing Sheets

CORD TILTER WITH AN ELEVATED START GEAR RATIO

TECHNICAL FIELD

The invention pertains generally to tilters for horizontal blinds and more particularly to a tilter utilizing a high gear ratio, a split wheel and a snap-on cradle.

BACKGROUND ART

Previously, many types of tilters have been used to provide an effective means for producing the required rotational motion to open and close the slats of a horizontal venetian blind. In some prior art the slats are partially rotated by a worm gear driven tilter at is actuated by a wand. The wand is rotated by a user's hand twisting the wand in the desired direction, thus permitting the movement to be transmitted by way of an endless screw which is located at fight angles to a spur-like gear.

Other patented devices utilize horizontal blinds that use a pulley, drum or an irregular shaped tilt rod on which a pair of cords or lines are attached. By pulling either one of the cords or lines an actuator is rotated, thus rotating the tilt rod proportionally to the line linear movement.

A search of the prior art did not disclose any patents that read directly on the claims of the instant invention, however the following U.S. patents are considered related:

| Patent Number | Inventor | Issue Date |
|---|---|---|
| 5,680,892 | Liu | Jul. 31, 1996 |
| 5,647,422 | Weng | Jun. 18, 1996 |

U.S. Pat. No. 5,680,892 issued to Liu discloses a slat angle adjusting device which has a body with a positioning member mounted on an upper side with two C-shaped forked ends, each mounted on one of the upper bent portions of a head rail. A roller is mounted in the head rail and attached to the outside of the body.

U.S. Pat. No. 5,647,422 issued to Weng is for a vertical blind assembly with a two piece housing. Two worm gears engage each other within the housing and a post is coupled to one of the worm gears for rotation. A beam is engaged to the other worm gear so as to be rotated by the post. A number of casings slideably engage the beam, and a pole supports a plurality of slats. The casings are secured to the housings by a number of couplers easily disengagable from the housings.

Lui in U.S. Pat. No. 5,636,677 teaches a slat angle adjusting device for a Venetian blend that includes a pair of casings coupled together with a pinion mounted therein. A worm and drive gear interface together with a drive axle formed in one end of the drive gear, extending outward from the casing. A bracket extends upward and a roller is mounted on the drive axle and is received between side walls of the bracket.

U.S. Pat. No. 5,341,865 issued to Fraser, et al., teaches a tilt roll mechanism with an asymmetrical cross section and includes bearings on a support that connects flexible cords of ladder laces that extend around a body. Control means are accomplished using a worm gear that engages a pinion, with appropriate number of teeth on the worm gear to prevent overtilting.

Rap, et al., in U.S. Pat. No. 5,297,789 discloses a tilter mechanism for a venetian blind that employs a fixed hollow drum secured to a head rail, and a hollow rotary mechanism that is positioned in the drum. A tilt cord is wound around the pulley and when pulled downward tilts the entire head rail thereby tilting the attached slats.

U.S. Pat. No. 4,821,789 issued to Van Rens is for a tilt drum which secures the upper ends of a cord ladder.

Valle, et al. in U.S. Pat. No. 4,676,292 teaches a tilter mechanism that uses a spur gear with a smooth peripheral portion having no teeth and a worm gear that engages the teeth for rotation by a wand.

For background purposes and as indicative of the art to which the invention is related reference may be made to the following remaining patents.

| U.S. Pat. No. | Inventor | Issue Date |
|---|---|---|
| 4,541,468 | Anderson | Sept. 11, 1985 |
| 4,487,243 | Debs | Dec. 11, 1984 |

DISCLOSURE OF THE INVENTION

Much of the prior art in today's marketplace is related to a tilter mechanism using a wand or a rigid operating rod for actuating the angular position of slats, which are employed in horizontal or venetian blinds. While this type of manual adjustment is the accepted method, the are many advantages to using a pair of lines or cords for actuation, as a similar type of control is commonly used to raise or lower the blinds. It is therefore, the primary object of the invention to employ a tilter mechanism that changes the tilt angle of the slats by using a pair of cords or lines each rotating the slats in an opposite direction using an elevated start gear ratio. Normally a one-to-one gear ratio is used in the venetian blind industry for rotating slats with a wand and it may be clearly seen that a faster ratio has advantages in this application.

An important object of the invention is that a separate cradle or adapter is used which mounts a tilter to the blind head rail through a square or rectangular hole located on a bottom section of the head rail. The cradle is removable from the main body or housing of the invention using a snap fastener type pin and socket, which allows the cradle to be easily interchanged. The purpose of its exchange ability is to permit the cradle to be colored to match the head rail of the blind, and, since the housing is hidden inside the channel-shaped rail, only the bottom of the device is visible. This object permits the use of a housing and gears of any color to be used in various applications while only the cradle requires changing to match colors. Since the cradle is simply snapped into place this change may be made easily, and stocking of many different colored devices is unnecessary since the relatively inexpensive removable cradle is the only element that must be color-coordinated. These features greatly increase the inventions desirability from an overall monetary viewpoint.

Another object of the invention is that the entire tilter may be made of thermoplastic, which is formed in quantity by the injection molding process. While the initial cost of tooling is relatively high, the piece price is basically low, therefore, economies of number are greatly enhanced with this invention.

Still another object of the invention is directed to the use of a split wheel to wind the lines or cords. Many types of venetian blinds use a single wheel for multiple cords which can easily become tangled or fouled ultimately causing extreme annoyance to the user. Since the wheel is split and each line has its own path separated by a physical barrier, and taken in conjunction with the fast acting gears which reduce the amount of winding necessary, any potential problem is greatly eliminated.

A final object of the invention is that the angle of the blind is controlled in increments by the use of teeth in the wheel gear shaft and a incremental positioning bushing located in the housing. This arrangement prevents backlash and permits the user to select the desired angle by the feel of the cords as they have an infinite number of stopping positions as the cord is pulled.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
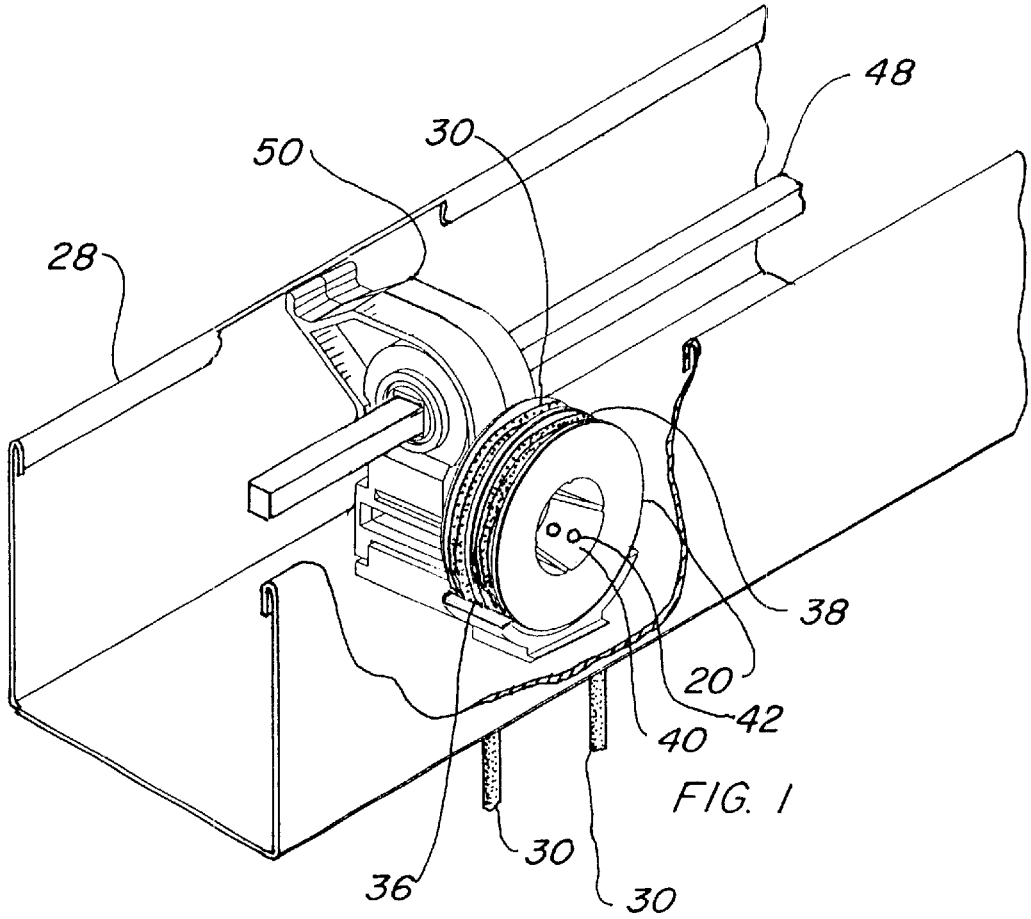
FIG. 1 is a partial isometric view of the preferred embodiment mounted within a venetian blind head rail with lines wrapped around the wheel gear and extending below the head rail.
Figure 2:
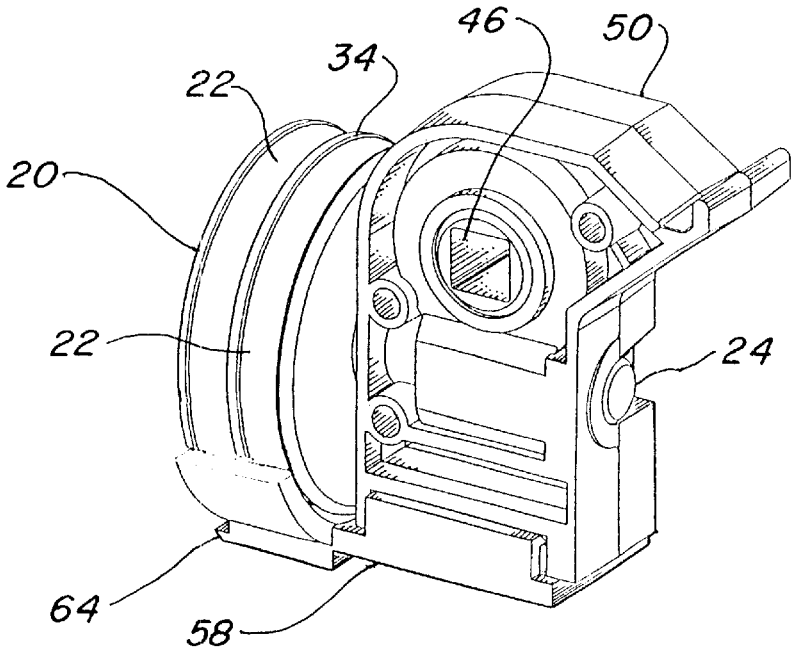
FIG. 2 is a partial isometric view of the preferred embodiment shown by itself.

The best mode for carrying out the invention is presented in terms of a preferred embodiment for a cord tilter with a four start gear. This preferred embodiment is shown in FIGS. 1 through 9 and is comprised of a wheel gear 20 that includes an integral, line actuated split wheel 22, an integral shaft 24 and a integral worm gear 26. The wheel gear is disposed within a venetian blind head rail 28, as shown in FIG. 1, with the split wheel 22 adapted to receive a pair of lines 30 through the head rail for rotating blind slats.

Figure 5:
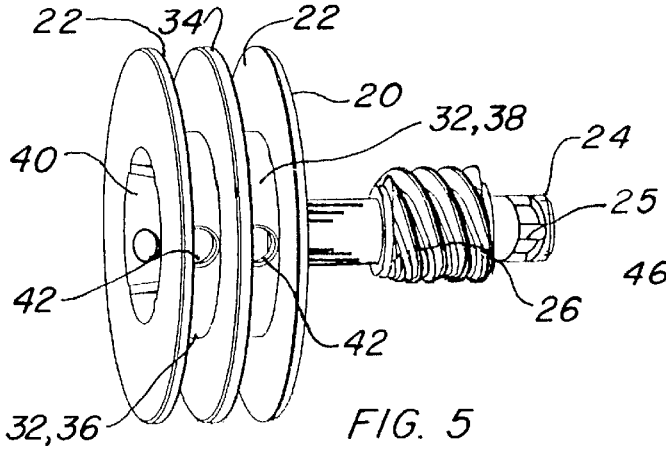
FIG. 5 is a partial isometric view of the wheel gear including the integral line actuated split wheel, integral shaft and integral worm gear, completely removed from the invention for clarity.

The split wheel 22, shown in FIG. 5, includes a drum 32 with a barrier 34 in a middle portion of the wheel for receiving each one of the lines 30, a first drum 36 for tilting the slats up, and a second drum 38 for tilting the slats down when either line is manually pulled in a downward direction. It should be noted that the sequential position of the first drum 36 and the second drum 38 may be reversed, however, the first drum 36 is shown in the drawings as the one on the outside of the tilter. The actual diameter of the drums 36 and 38 is of little importance as the lines 30 simply need enough surface to wrap around. During use the excess length of the lines may be stored for convenience, since the actual installation of the blind in a specific window may require more or less length for accessibility. The split wheel 22 further includes a hollow hub 40 with a number of bores 42 therethrough, preferably four, as shown in FIG. 5, for attachment and termination of the lines 30 using knots or the like on the ends.

The wheel gear 20, in the preferred embodiment is formed of a thermoplastic material which may include: polycarbonate, polystyrene, ABS, polyethylene, polypropylene, polyvinylchloride, and the like. However, other materials such as metal may also be used with equal ease for functionality even though it may incur a higher cost to produce.

A helical gear 44, with a tilt rod bore 46 therethrough, is intermeshed with and driven by the wheel gear 20 to rotate blind slats through a tilt rod 48, as illustrated in FIG. 1. The tilt rod 48 interfaces with other blind components within the head rail 28, such as a tilt roll mechanisms, to tilt the ladder laces of venetian blinds, all of which are well known in the art.

Figure 6:
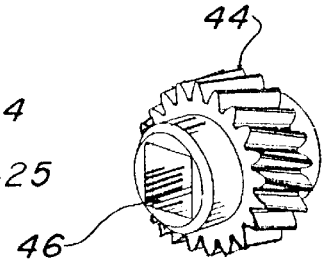
FIG. 6 is a partial isometric view of the helical gear completely removed from the invention for clarity.
Figure 7:
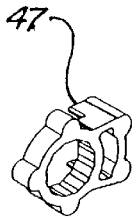
FIG. 7 is a partial isometric view of the incremental positioning bushing completely removed from the invention for clarity.
Figure 9:
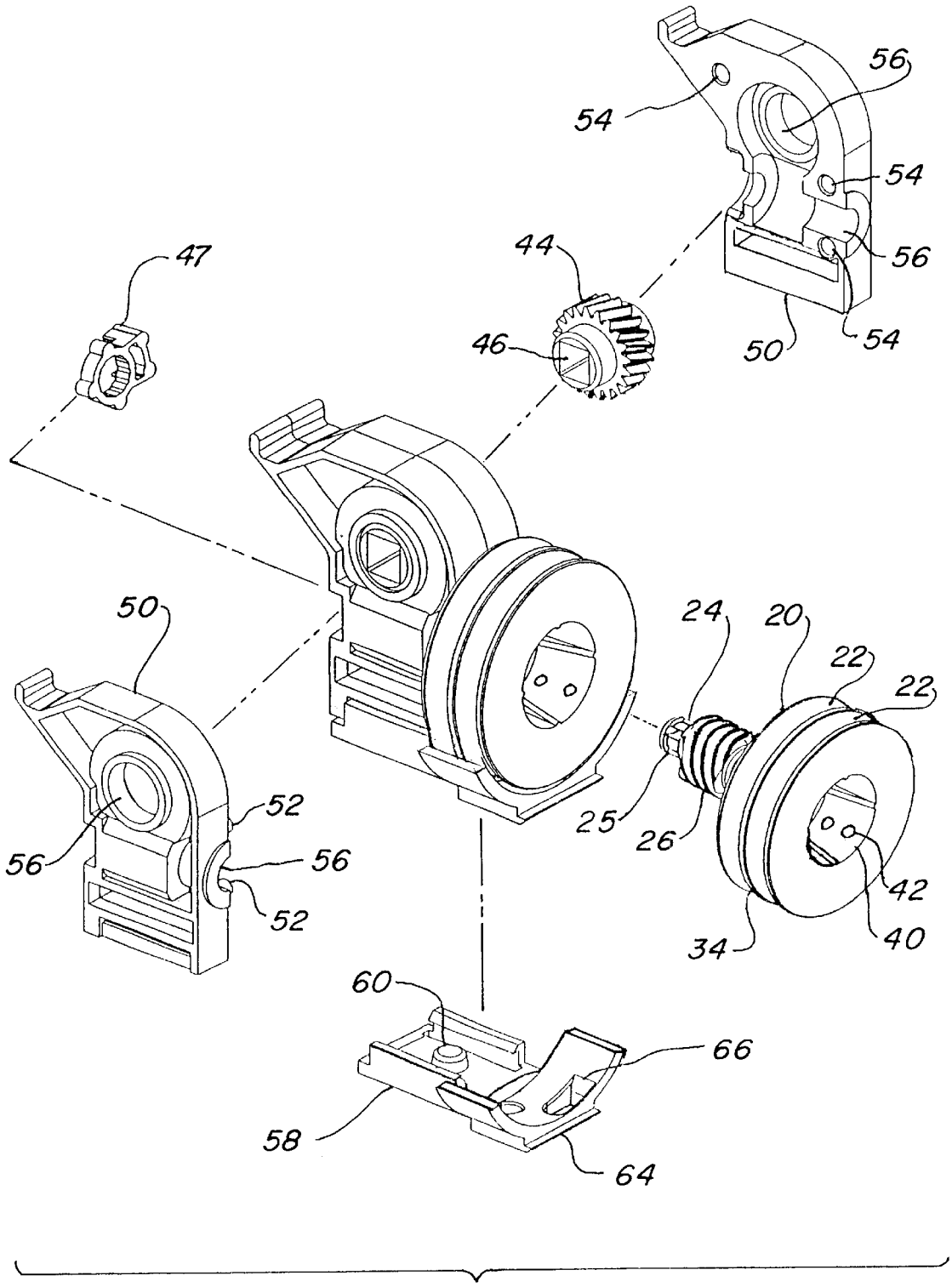
FIG. 9 is an exploded view of the cord tilter illustrating the five major elements in the preferred embodiment.

The helical gear 44, as shown in FIG. 6, is basically a spur-like gear which has the same angular displacement as the worm gear 26, thus permitting them to interface with each other. The tilt rod bore 46 is at least 0.375 inches (9.53 mm) square in the preferred embodiment and is sized to accept the rod with a clearance fit. While this size is normally selected in the industry, any dimension is acceptable. The worm gear 26 is actually an endless screw, and both the worm gear 26 and helical gear 44 have either a three or four to one rotational ratio such that when the split wheel 22 with its integral worm gear 26 is rotated by the line 30, the helical gear 44 along with the tilt rod 48 increases their rotational movement by a factor of three or four, which is sometimes designated as a 3:1 ratio or a 4:1 ratio. The material of the helical gear 44 is the same thermoplastic or metal as the wheel gear 20 previously described. In order to prevent the gear 44 from having back lash after being rotated and to add slight resistance for positioning the angle of the horizontal blind slats the shaft 24 includes a plurality of teeth 25 located near the shaft end opposite the split wheel 22. Any number of teeth may be used however it has been found that four is about ideal. An incremental positioning bushing 47, as shown by itself in FIG. 7 and also in the exploded view of FIG. 9, is positioned just outside orifices 56 within the housing 50. The incremental positioning bushing 47 is configured to be retained by the shaft 24 and the housing 50 and includes a plurality of radial indentations that interface with the positioning teeth 25 within the shaft 24 creating the desired resistance and propensity to stop in an incremental manner. The bushing 47 is fabricated of the same thermoplastic as previously mentioned.

Figure 3:
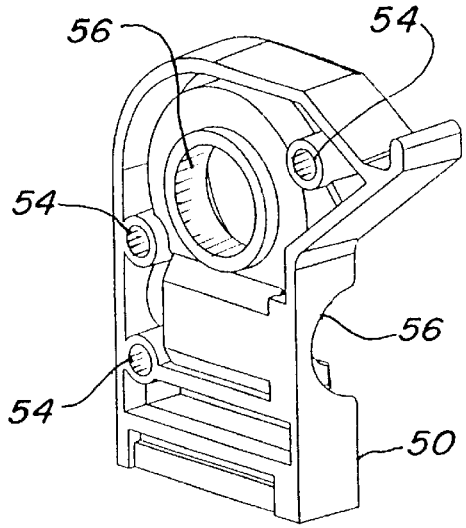
FIG. 3 is a partial isometric view of the first half of the housing, completely removed from the invention for clarity.
Figure 4:
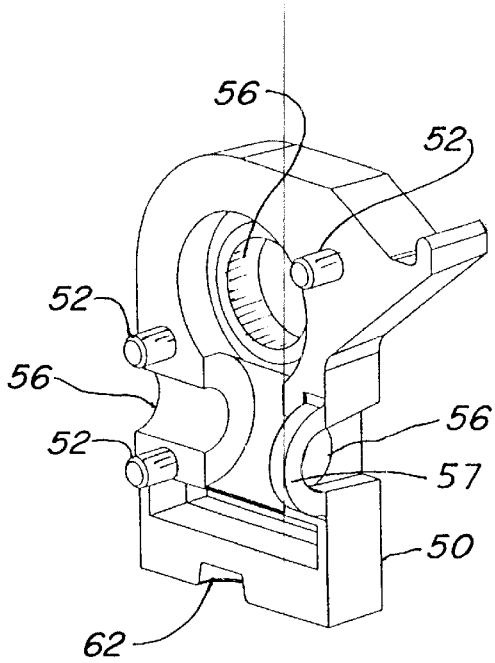
FIG. 4 is a partial isometric view of the second half of the housing, completely removed from the invention for clarity.

The housing 50 surrounds the wheel gear 20 and helical gear 44, thus permitting the wheel gear and helical gear to rotate freely when the lines 30 wrapped around the split wheel 22 are pulled downward to achieve a desired angular position of the horizontal blind slats. The housing 50 is formed of two separate pieces as shown separated in FIGS. 3 and 4, and as they are fabricated of the same thermoplastic material as the gears 20 and 44, they are attached together with bosses 52 that align with mating cavities 54 and then ultrasonically welded or bonded with adhesive after assembly of the gears. It should be noted that the helical gear 44 is rotatably supported at right angles to the wheel gear 20 by orifices 56 in the housing 50, as depicted in FIGS. 3 and 4. The housing also includes a loop 57, as shown in FIG. 4, which adds strength to the housing 50 to aid in preventing the housing from splitting.

Figure 8:
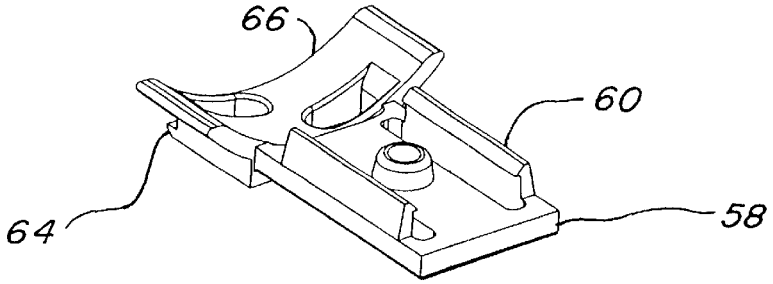
FIG. 8 is a partial isometric view of the cradle completely removed from the invention for clarity.

A cradle 58, as shown by itself in FIG. 8, is positioned adjacent to the housing 50 and includes at least one snap stud 60, and the housing 50 has a mating socket 62 configured to attach the cradle 58 to the housing 50 in a snap fastener manner. While a single stud 60 and socket 62 is described, any number of mating pairs may be used with equal ease. The cradle 58 is then snapped into the housing 50 and is basically used for removably mounting the titter in the bottom of the head rail 28. The cradle further has a downward-protruding, beveled projection 64 configured to mate with a square or rectangular hole in a head rail 28 for snapping the cord tilter in place, as shown in FIG. 1, thus providing securement of the cord tilter to the rail. FIGS. 8 and 9 illustrate a pair of slots 66 that are formed in the cradle 58 to permit the lines 30 to pass through as depicted in FIG. 1. The cradle 58 may be the same color as the other elements or have a color to match the head rail 28. This color may actually disregard the hue of the housing and gears thus permitting convenient color-coordination of the tilter with its surroundings by simply snapping an alternate cradle 58 in place on the housing 50.

In order to install the tilter in a head rail 28, a line 30 is passed through the bores 42 in the hub 40 with the open ends penetrating and the ends tied in a knot or some other restricting device is added. The lines 30 are then wrapped around the drums 32 and threaded through the slots 66 in the cradle 58. The tilter is then placed into the channel shaped head rail 28, and the top of the housing 50 is placed under the lip of the head rail. The bottom of the cradle 58 is then snapped into a square or rectangular hole in the web of the rail with the beveled projection 64 and rail deforming slightly to accommodate the snap action. Since the lines 30 are protruding from the bottom of the cradle 58 they are free to dangle downward when the rail, along with the other operational elements are attached. It should also be noted that the tilt rod 48 is inserted into the tilt rod bore 46 to tilt the slats of the blind when assembly is completed.

To operate the tilter one of the lines 30 is pulled downward by hand, this action rotates the tilt rod 48 with its accompanying apparatus tilting the blind slats in the appropriate direction. To reverse the rotation of the slats, the opposite line 30 is pulled.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. A cord tilter with a four start gear, for use with a horizontal slatted blind that employs a head rail and a tilt rod comprising:

a) a wheel gear having an integral line actuated split wheel, an integral shaft and a integral worm gear, the wheel gear disposed within the head rail, with the wheel adapted to receive a pair of lines through the head rail for rotating blind slats, b) a helical gear having a tilt rod bore therethrough intermeshing with and driven by the wheel gear to rotate blind slats through a tilt rod interface connection housed within the head rail, c) a housing surrounding the wheel gear and helical gear permitting the wheel gear and helical gear to rotate freely when lines wrapped around the split wheel are pulled downward to achieve a desired angular position of horizontal blind slats, and d) a cradle snapped into the housing for removably mounting the cord tilter in a head rail.

2. The cord titter as recited in claim 1 wherein said split wheel further comprises unitary construction having a drum with a barrier in a middle portion of the wheel for receiving a pair of lines, a first one for tilting slats up and a second one for tilting slats down when either line is manually pulled in a downward direction.

3. The cord tilter as recited in claim 2 wherein said split wheel further comprises a hollow hub having a plurality of bores therethrough for attachment and termination of lines to prevent slippage and ease of cording.

4. The cord tilter as recited in claim 3 wherein said plurality of bores comprise three or four bores.

5. The cord tilter as recited in claim 1 wherein said worm gear is an endless screw and the worm gear and helical gear have either a three to one ratio or a four to one ratio such that when the split wheel with integral worm gear is rotated by a line the helical gear and tilt rod increases its rotational direction by a factor of three or four respectively.

6. The cord tilter as recited in claim 1 wherein said wheel gear including the integral line actuated split wheel, integral shaft and integral worm gear are injected molded thermoplastic.

7. The cord tilter as recited in claim 1 wherein said helical gear is a spur-like gear and said rod bore is at least ⅜ inch (9.53 mm) square.

8. The cord tilter as recited in claim 1 wherein said helical gear is injected molded thermoplastic.

9. The cord tilter as recited in claim 1 wherein said helical gear is metal.

10. The cord tilter as recited in claim 1 wherein said helical gear is rotatably supported at right angles to said wheel gear by said housing.

11. The cord tilter as recited in claim 1 wherein said housing is formed of two separate pieces.

12. The cord tilter as recited in claim 1 wherein said housing is injection molded thermoplastic.

13. The cord tilter as recited in claim 1 wherein said cradle further comprises a downward-protruding, beveled projection configured to mate with a hole in a head rail for snapping the cord tilter in place, thus providing securement of the cord tilter.

14. The cord tilter as recited in claim 1 wherein said cradle further comprising a pair of slots for permitting lines to pass therethrough.

15. The cord tilter as recited in claim 1 wherein said cradle further comprising a snap stud positioned adjacent to the housing, and, said housing having a mating socket configured to attach the cradle to the housing with a snap fastener.

16. The cord tilter as recited in claim 1 wherein said cradle further having a color to match a head rail color disregarding the hue of the housing and gears permitting convenient harmonization of the tilter with its surroundings.

17. The cord tilter as recited in claim 1 wherein said wheel gear integral shaft further having positioning teeth therein and a incremental positioning bushing is disposed upon the shaft over the teeth and held in place by the housing adding incremental resistance to the cord tilter preventing backlash and defining an angular position of blind slats used in conjunction with the tilter.

18. A cord tilter with a four start gear for a horizontal slatted blind that employs a head rail and a tilt rod comprising:

a) a wheel gear having an integral line actuated split wheel, disposed within a head rail, with the wheel adapted to receive a pair of lines through the head rail for rotating blind slats, b) a helical gear intermeshing with and driven by the wheel gear to rotate blind slats through a tilt rod interface within the head rail, c) a housing surrounding the wheel gear permitting the gears to rotate freely when lines wrapped around the split wheel are pulled downwardly to achieve a desired angular position of horizontal blind slats, and d) a cradle snapped into the housing for removably mounting the cord tilter in a head rail.

* * * * *